US006633129B2

(12) United States Patent
Mako

(10) Patent No.: US 6,633,129 B2
(45) Date of Patent: Oct. 14, 2003

(54) ELECTRON GUN HAVING MULTIPLE TRANSMITTING AND EMITTING SECTIONS

(75) Inventor: Frederick M. Mako, 6308 Youngs Branch Dr., Fairfax Station, VA (US) 22039

(73) Assignees: Frederick M. Mako, Fairfax Station, VA (US); Ansel M. Schwartz, Pittsburgh, PA (US)

( * ) Notice: Subject to any disclaimer, the term of this patent is extended or adjusted under 35 U.S.C. 154(b) by 0 days.

(21) Appl. No.: 09/991,294

(22) Filed: Nov. 21, 2001

(65) Prior Publication Data

US 2002/0149316 A1 Oct. 17, 2002

Related U.S. Application Data

(63) Continuation of application No. 08/651,626, filed on May 22, 1996, now abandoned, which is a continuation-in-part of application No. 08/348,040, filed on Dec. 1, 1994, now abandoned.

(51) Int. Cl.[7] ..... H01J 23/06

(52) U.S. Cl. ..... 315/5.11; 315/5.33; 315/5.14; 315/5.35; 315/5.37; 315/5.12; 313/103 R; 313/104

(58) Field of Search ..... 315/4, 5, 5.11, 315/5.12, 5.14, 5.16, 5.33, 5.34, 5.35, 5.37, 5.43; 313/103 R, 104; 331/79; 327/301

(56) References Cited

U.S. PATENT DOCUMENTS 2,591,322 A * 4/1952 Warnecke ..... 315/5.12

* cited by examiner

*Primary Examiner*—Benny T. Lee
(74) *Attorney, Agent, or Firm*—Ansel M. Schwartz

(57) ABSTRACT

An electron gun that generates multiple electron bunches and the application of this gun to produce rf energy. The electron gun includes an rf input cavity having a first side with multiple emitting surfaces and a second side with multiple transmitting and emitting sections. The gun also includes a mechanism for producing a rotating and oscillating force which encompasses the multiple emitting surfaces and the multiple sections so electrons are directed between the multiple emitting surfaces and the multiple sections to contact the multiple emitting surfaces and generate additional electrons and to contact the multiple sections to generate additional electrons or escape the cavity through the multiple sections. A method for producing multiple electron bunches.

7 Claims, 12 Drawing Sheets

Plot of the peak particle energy versus frequency. 1 Data Points obtained from computer simulation. 2 A graph with the best fit to the simulation data.

Plot of saturated current density versus normalized drive voltage at a frequency of 2.85 GHz for: 1 electrode gap spacing of 0.5 cm, 2 gap=1.0 cm and 3 gap= 2.0 cm.

Plot of the peak RF voltage versus normalized drive voltage at a frequency of 2.85 GHz for: 1 electrode gap spacing of 0.5 cm, 2 gap=1.0 cm and 3 gap= 2.0 cm.

Plot of the pulse width (full width at half maximum) versus normalized drive voltage for: 1 electrode gap spacing of 0.5 cm, 2 gap=1.0 cm and 3 gap= 2.0 cm. The frequency is 2.85 GHz.

Plot of the peak particle energy versus resonant voltage. 1 Data Points obtained from computer simulation. 2 A graph with the best fit to the simulation data.

Plot of the saturated current density versus electrode gap spacing. 1 Data Points obtained from computer simulation. 2 A graph with the best fit to the simulation data.

Plot of the peak particle energy versus electrode gap spacing. 1 Data Points obtained from computer simulation. 2 A graph with the best fit to the simulation data.

Plot of the resonant peak voltage versus electrode gap spacing. 1 Data Points obtained from computer simulation. 2 A graph with the best fit to the simulation data.

Plot of RF power requirement versus frequency for: 1 electrode gap spacing of 0.5 cm, 2 gap=1.0 cm and 3 gap= 2.0 cm.

Illustration of emittance growth due to double-grid extraction with an injected energy of 50 kV. 1 Beam emittance before going through the grids. 2 Beam emittance after going through both grids. 3 The grid transmission factor using wires with thickness of 0.1 mm.

Plots of beam emittance and pulse width versus effective solenoid radius. 1 Emittance before compression. 2 Emittance after beam compression. 3 Pulse width after compression for beam bunch with initial pulse width of 9 ps.

Plots of axial magnetic field for solenoid radius of: 1- 25 cm, 2- 30 cm, 3- 35 cm, 4- 40 cm, and 5- 50 cm.

Plot of the RF electric field excited inside the output cavity by the micro-pulse. 1 Data points obtained from 3D-Pic computer simulation. 2 The analytical field profile for the $TM_{040}$ mode.

Plots of output cavity efficiency versus beam emittance for a beam radius of 4.5 mm in a $TM_{040}$ cavity at 11.4 GHz. 1 Beam current density is 500 A/cm$^2$. 2 Beam current density is 1000 A/cm$^2$. 3 Beam current density is 1500 A/cm$^2$.

ELECTRON GUN HAVING MULTIPLE TRANSMITTING AND EMITTING SECTIONS

This is a continuation of U.S. patent application Ser. No. 08/651,626 filed May 22, 1996, abandoned, which is a continuation-in-part of U.S. patent application Ser. No. 08/348,040 filed Dec. 1, 1994, abandoned.

FIELD OF THE INVENTION

The present invention is related to electron guns for producing bunched electrons and subsequently using those electron bunches to generate rf energy. More specifically, the present invention is related to an electron gun that uses an rf cavity subjected to a rotating and oscillating electric field at a given frequency for the production of bunched electrons and uses an output cavity for the production of a higher frequency and higher power oscillating electric field than that power and frequency in the input cavity.

BACKGROUND OF THE INVENTION

The development of high-current, short-duration pulses of electrons has been a challenging problem for many years. High-current pulses are widely used in injector systems for electron accelerators, both for industrial linear accelerators (linacs) as well as high-energy accelerators for linear colliders. Short-duration pulses are also used for microwave generation, in klystrons and related devices, for research on advanced methods of particle acceleration, and for injectors used for free-electron laser (FEL) drivers. During the last few years, considerable effort has been applied to the development of high power linac injectors [J. L. Adamski et al., IEEE Trans. Nucl. Sci. NS-32, 3397 (1985); T. F. Godlove and P. Sprangle, Part. Accel. 34, 169 (1990).] and particularly to laser-initiated photocathode injectors [J. S. Fraser and R. L. Sheffield, IEEE J. Quantum Elec. QE-23, 1489 (1987); R. L. Sheffield, E. R. Gray and J. S. Fraser, Proc. 9th Int'l FEL Conf., North Holland Publishing Amsterdam, p. 222, 1988; P. J. Tallerico, J. P. Coulon, LA-11189-MS (1988); M. E. Jones and W. Peter, IEEE Trans. Nucl. Sci. 32 (5), 1794 (1985); and P. Schoessow, E. Chojnacki, W. Gai, C. Ho, R. Konecny, S. Mtingwa, J. Norem, M. Rosing, and J. Simpson, Proc. of the 2nd Euro. Part. Accel. Conf (1990), p. 606.]. The best laser injectors have somewhat higher quality beams than more conventional injectors such as in reference [J. L. Adamski et al., IEEE Trans. Nucl. Sci. NS-32, 3397 (1985)], but the reliability depends on the choice of photocathode material, with the more reliable materials requiring intense laser illumination.

The methods used to date are rather complex, cumbersome, expensive, and have very definite limits on performance.

The next generation of TeV linear colliders for high energy physics will require rf sources capable of 500 MW/m of rf power with a typical pulse length of 50 ns. This requires a 50 MW source with a corresponding pulse width of 1 $\mu$s at a frequency between 10 and 20 GHz before pulse compression [R. Ruth, ed., Report of the Linear Collider Working Group, Proceedings of the 1990 Summer Study on High Energy Physics, Snowmass, Colo., Jun. 25–Jul. 13, 1990]. Because the cost of the rf sources will be a large fraction of the operating cost of the accelerator, there is a need for high-power microwave sources capable of multi-megawatt performance at high efficiency. To ensure that modulator costs do not become excessive, the potential driver should also be able to satisfy the above requirements working at a voltage of about 600 kV.

Considerable effort has gone into extending the frequency and power capabilities of "conventional" klystrons [T. G. Lee, G. T. Konrad, Y. Okazaki, Masuru Watanabe, and A. Yozenawa, IEEE Trans. Plasma Sci., PS-13, No. 6,545 (1985); M. A. Allen et al, LINAC Proc. 508 (1989) CEBAF Report No. 89-001; M. A. Allen et al, Phys. Rev. Lett. 63, 2472 (1989)] to cope with the requirements of future linear colliders. At this frequency range, klystrons tend to become small and rf breakdown in the cavities and gaps becomes very difficult to avoid. The output power of the device is then constrained by the maximum electric field that the gap can sustain. As the frequency is increased the gap is reduced and so is the output power. In recent X-band klystron experiments at SLAC designed to produce 100 MW output power at 11.4 GHz, 52 MW was obtained with 1 $\mu$s pulses at an efficiency of 30%. Output power was limited by breakdown in the output structures [G. Caryotakis, SLAC-PUB-6361 September 1993 (A)] and problems such as beam interception in the beam tunnels were also encountered.

Interest has increased in recent years in pursuing other methods of microwave generation oriented towards coping with the requirements of future TeV linear colliders. A group at the University of Maryland is pursuing an X-band gyroklystron amplifier [V. L. Granatstein et al "High-power Microwave Sources for Advanced Accelerators", Am. Inst. of Phys. Conf. Proc. 253 (1991); W. Lawson, J. P. Calame, B. Hogan, P. E. Latham, M. E. Read, V. L. Granatstein, M. Reiser and C. D. Striffler, Phys. Rev. Lett. 67, 520 (1991); W. Lawson, J. P. Calame, B. Hogan, M. Skopec, C. D. Striffler, V. L. Granatstein, and W. Main, IEEE Trans. Plasma Sci. 1992; and S. Tantawi, W. Main, P. E. Latham, G. Nusinovich, B. Hogan, H. Matthews, M. Rimlinger, W. Lawson, C. D. Striffler, and V. L. Granatstein, IEEE Trans. Plasma Sci. (1992)]. At Novosibirsk, in the former Soviet Union, a significant advance has been made with the invention of the magnicon [Karlimer, et al, Nucl. Inst. and Meth A269 (1988), pp 459–473] which has produced 2.6 MW at 0.915 GHz with an impressive conversion efficiency of 76%. In the magnicon the proper adjustment of a focusing static magnetic field allows the electrons in the beam to maintain temporal phase coherence with the rotating modes contained in suitable microwave resonators. This results in long and efficient interactions i.e., longer cavities, which is an advantage over klystron and gyro-klystron cavities. In the United States, a harmonic experiment is currently being conducted at the Naval Research Laboratory (NRL). The input scanner resonator is driven at 5.7 GHz and power is extracted from a gyroresonant harmonic interaction ($TM_{210}$ rotating mode) at 11.4 GHz [W. M. Manheimer, IEEE Trans. Plasma Sci. 18, 632 (1990); and B. Hafizi, Y. Seo, S. H. Gold, W. M. Manheimer and P. Sprangle, IEEE Trans. Plasma Sci. 20, 232, (1992)].

SUMMARY OF THE INVENTION

The described invention is a high power frequency multiplying device that utilizes a "Gatling" Micro-Pulse Gun (GMPG). The GMPG produces a number of electron bunches per rf period using a natural bunching process that results from resonant amplification of a current of secondary electrons in an rf input cavity. This natural bunching provides high-current densities (0.005–10 kA/cm$^2$) in short-pulse (1–100 ps) beams, which when combined with a rotating mode, can produce many bunches per rf period and therefore can be used for frequency multiplication in an output cavity. The GMPG is an outgrowth of a simpler device, the Micro-Pulse Gun (MPG) [Patent Pending], that operates on the same fundamental principle but with only one bunch per rf period. Unlike thermionic or field emission devices which have a relatively short lifetime, the GMPG secondary emission process does not cause erosion or evaporation and therefore will have a longer lifetime. Furthermore, the natural bunch formation is a resonant process which is not prone to phase instability.

A system is described for producing a high-power high frequency microwave generator using a Gatling Micro-Pulse Gun. The system consists of five distinct components: (1) the GMPG which includes an output grid; (2) a post-acceleration section; (3) a radial magnetic compression section; (4) an output cavity; and (5) a beam collector. The system has been characterized in detail for: the transverse normalized emittance ["The Physics of Charged-Particle Beams", I. D. Lawson, Clarendon Press, Oxford, (1977), p. 181], energy spread, and bunch expansion throughout the entire system. This is important for determining the output power and system efficiency.

The basis of the concept is a novel device to generate multiple, high-current density, micro-pulse electron bunches. The device is named the Gatling Micro-pulse Gun (GMPG). It utilizes the resonant amplification of electron current by secondary emission in an rf cavity, with pre-designated areas on one side of the cavity that are partially transparent to allow the transmission of output bunches. Multiple bunches are produced sequentially during an rf period by exploiting the unique properties of a rotating electromagnetic mode. The mode illustrated is $TM_{010}$. This method allows frequency multiplication in an output cavity.

One application of the GMPG is high-power, high-frequency microwave generation. The narrow bunches are required for this application.

The final current density in the GMPG increases rapidly with frequency, namely as frequency cubed. The upper frequency will be limited by practical considerations such as required peak power, finite secondary emission time, secondary-emission current density for the input cavity, and breakdown in the output cavity.

The GMPG has been thoroughly characterized by finding the saturated current density dependence on the gap spacing, peak cavity voltage, resonant frequency and applied axial magnetic field. The peak particle energy emerging from the GMPG has also been characterized by finding its dependence on gap spacing, peak cavity voltage and frequency. Peak particle energy from the input cavity always corresponds to about, 75% of the peak rf voltage. Beam loading and frequency shift have been evaluated and can easily be tolerated. Setting up the required $TM_{110}$ rotating mode in the input cavity of the GMPG has been established along with means to efficiently couple power into the GMPG without significant mode distortion. Absolute power requirements and the loaded Q of the GMPG have been found and are not restrictive. Breakdown in the input cavity has been examined and is not a problem. The beam emittance has been determined for various conditions of grid wire thickness, grid wire densities, axial magnetic field strengths, and magnetic scale length. While the presence of the output grids causes some emittance growth, the results are not significant for the intended application. Both rf and post acceleration field leakage through the grid region have been evaluated and shown to be insignificant. The GMPG mechanism minimizes emittance growth compared to a DC type gun. Resonant particles are loaded into the wave at near zero rf phase angle; thus, the resonant particles experience a much lower transverse kick from the grid wires. Also, by providing a 45° radial focusing electrode after the second grid, the transverse field at the second grid is reduced significantly, which minimizes emittance growth. The only significant transverse emittance growth comes from the magnetic compression region, which only causes a reduction in the output cavity efficiency of about 3%. Grid heating has been shown not to be a problem. An input cavity design has been used which includes tapered waveguide for feeding in rf power and provides electric and magnetic beam focusing. In addition, various materials have been used for fabrication of the input cavity.

During post-acceleration, the transverse emittance growth and bunch expansion do not significantly affect the system performance. A design utilizing pulsed high voltage was used for post acceleration.

Magnetic compression is used to bring the bunches near the axis for injection into the output cavity. The most significant increase in transverse emittance occurs in this section. However, the loss of device efficiency is only a few percent.

The fourth component of the system is the output cavity. For good coupling, low transverse emittance growth (or high beam conversion efficiency) and high power handling, the $TM_{040}$ mode was used. The $TM_{040}$ mode locks at the output frequency and shows no mode competition. The fifth component is the beam collector which is also used for energy recovery.

With operation at an rf output power of 50 MW at 11.4 GHz, the resulting system efficiency is 59% without beam energy recovery and 75% with beam energy recovery. The system efficiency includes the input cavity efficiency, input driver efficiency (a 15 MW klystron at 2.85 GHz), output cavity efficiency, and the beam collector conversion efficiency. Breakdown in the output cavity appears to be manageable. One of the advantages of the GMPG over a klystron is that the bunch length is short compared to the rf period, which gives rise to higher beam to rf conversion efficiency.

The first component of the present invention pertains to the electron gun. The electron gun comprises an rf cavity having a first side with emitting surfaces and a second side with transmitting and emitting sections. The gun is also comprised of a mechanism for producing a rotating and oscillating force which encompasses the emitting surfaces and the sections so electrons are directed between the emitting surfaces and the sections to contact the emitting surfaces and generate additional electrons and to contact the sections to generate additional electrons or escape the cavity through the sections.

The sections preferably isolate the cavity from external forces outside and adjacent to the cavity. The sections preferably include transmitting and emitting grids. The grids can be of an annular shape, or of a circular shape, or of a rhombohedron shape.

The mechanism preferably includes a mechanism for producing a rotating and oscillating electric field that provides the force and which has a radial component that prevents the electrons from straying out of the region between the grids and the emitting surfaces. Additionally, the gun includes a mechanism for producing a magnetic field to force the electrons between the grids and the emitting surfaces.

The first component of the present invention pertains to a method for producing electrons. The method comprises the steps of moving at least a first electron in a first direction at one location. Next there is the step of striking a first area with the first electron. Then there is the step of producing additional electrons at the first area due to the first electron.

Next there is the step of moving electrons from the first area to a second area and transmitting electrons through the second area and creating more electrons due to electrons from the first area striking the second area. These newly created electrons from the second area then strike the first area, creating even more electrons in a recursive, repetitive manner between the first and second areas. This process is also repeated at different locations.

The second component of the present invention pertains to the post-acceleration to high energy of the electron bunches from the first component, the electron gun. Outside the transmitting area of the electron gun an accelerating electric field provides the means to accelerate the electron bunches to high energy.

The third component of the present invention pertains to the means for decreasing the radial location of electron bunches. After post-acceleration, the electron bunches have to be prepared for the interaction in the fourth component, the output cavity. An external magnetic field which increases in strength along the path of the accelerated electron bunches is used as a means to decrease the radial position of the electron bunches so that they can be injected into the output cavity. The radial decrease is performed in such a way that the radial position of the bunches, after reduction, is equal to the radius at which the output cavity electric field is at a peak.

The fourth component of the present invention pertains to the means for producing coherent microwave radiation in a cylindrical output cavity. The driving source of energy comes from the electron bunches arriving into the output cavity, one every rf period of the output cavity radiation frequency. The intention is to force the bunches to couple near the peak of the axial electric field of the design mode. The electron bunches are allowed to pass through holes that are equally-spaced azimuthally in the output cavity walls (both front and back faces).

The fifth component of the present invention provides a means to collect the electron bunches and provide energy recover so as to produce a voltage to accelerate the initial electron bunches.

The present invention pertains to an electron gun. The electron gun comprises an rf cavity having a first side with multiple non-simultaneous emitting surfaces and a second side with multiple transmitting and emitting sections. The electron gun also comprises a mechanism for producing a rotating and oscillating force which encompasses the multiple emitting surfaces and the multiple sections so electrons are directed between the multiple emitting surfaces and the multiple sections to contact the multiple emitting surfaces and generate additional electrons and to contact the multiple sections to generate additional electrons or escape the cavity through the multiple sections.

The present invention pertains to an apparatus for generating rf energy. The apparatus comprises a mechanism focusing non-simultaneous multiple electron bunches. The apparatus also comprises an output cavity which receives non-simultaneous multiple electron bunches and produces rf energy as the non-simultaneous multiple electron bunches pass through it.

The present invention pertains to a method for producing electrons. The method comprises the steps of moving at least a first electron in a first direction at a first time. Then there is the step of moving at least a second electron in the first direction at a second time. Next, there is the step of striking a first area with the first electron. Next, there is the step of producing additional electrons at the first area due to the first electron. Then, there is the step of moving electrons from the first area to a second area. Next, there is the step of transmitting electrons to the second area and creating more electrons due to electrons from the first area striking the second area. Then, there is the step of striking a third area with the second electron. Next, there is the step of producing additional electrons at the third area due to the second electron. Next, there is the step of moving electrons from the third area to a fourth area. Then, there is the step of transmitting electrons to the fourth area and creating more electrons due to electrons from the third area striking the fourth area.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 19:
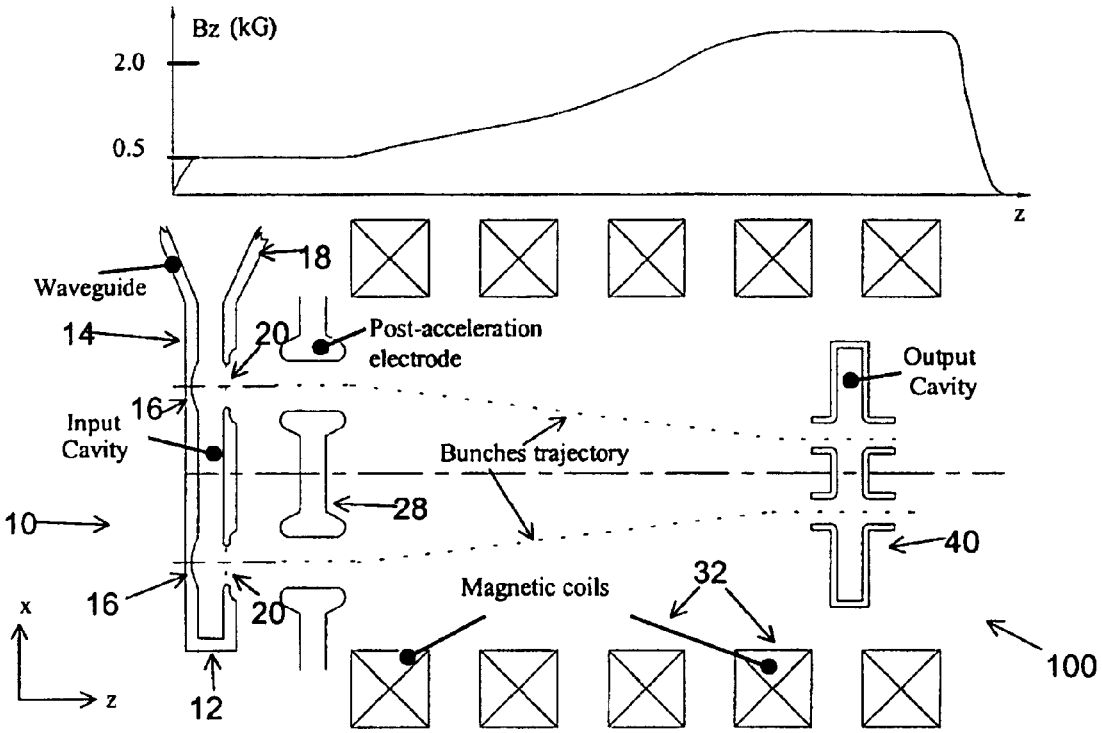
FIG. 19 Overall schematic of the GMPG's device with frequency multiplying. After undergoing post-acceleration, the micro-bunches are adiabatically compressed towards the axis for injection into the output cavity. This representative device is for the $TM_{040}$ mode in the output cavity.
Figure 23:
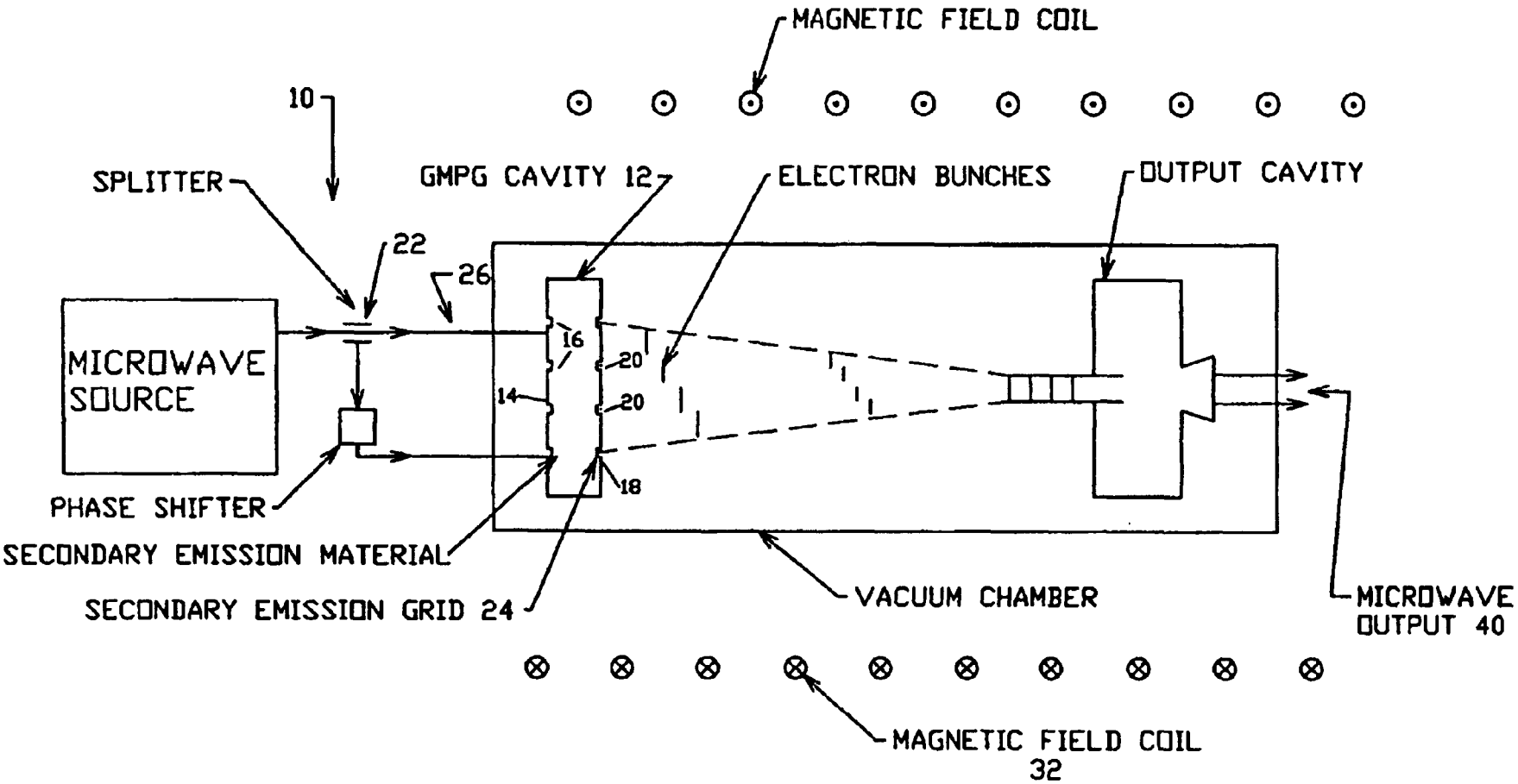
FIG. 23 Schematic representation of the robust pierce gun.

Referring now the drawings wherein like reference numerals refer to similar or identical parts through the several views, and more specifically to FIGS. 19 and 23 thereof, there is shown an electron gun 10. The electron gun 10 comprises an rf cavity having a first side 14 with multiple non-simultaneous emitting surfaces 16 and a second side 18 with multiple transmitting and emitting sections 20. The electron gun 10 also comprises a mechanism 22 for producing a rotating and oscillating force which encompasses the multiple emitting surfaces 16 and the multiple sections 20 so electrons are directed between the multiple emitting surfaces 16 and the multiple sections 20 to contact the multiple emitting surfaces 16 and generate additional electrons and to contact the multiple sections 20 to generate additional electrons or escape the cavity through the multiple sections 20.

Preferably, each section isolates the cavity from external forces outside and adjacent the cavity. The multiple sections 20 preferably include transmitting and emitting double grids. Preferably the multiple grids 24 are of an annular shape. Alternatively, the multiple grids 24 are of a circular shape or of a rhombohedron shape.

The producing mechanism 22 preferably includes a mechanism 26 for producing a rotating and oscillating electric field that provides the force and which has a radial component that confines the electrons to the multiple regions between the emitting grids 24 and the emitting surfaces 16. Additionally, the producing mechanism 22 includes a mechanism for producing multiple bunches of electrons in the multiple regions 30 between the multiple emitting grids 24 and the multiple emitting surfaces 16. Additionally, the gun 10 can include a mechanism 32 for producing a magnetic field to confine the electrons to the multiple regions between the multiple emitting grids 24 and the multiple emitting surfaces 16. Additionally, the gun can include a mechanism for producing an electrostatic electric field 28 to confine and accelerate the electron bunches after exiting the multiple sections 20.

The present invention pertains to an apparatus 10 for generating rf energy. The apparatus comprises a mechanism focusing non-simultaneous multiple electron bunches. The apparatus 10 also comprises an output cavity 40 which receives non-simultaneous multiple electron bunches and produces rf energy as the non-simultaneous multiple electron bunches pass through it.

The present invention pertains to a method for producing electrons. The method comprises the steps of moving at least a first electron in a first direction at a first time. Then there is the step of moving at least a second electron in the first direction at a second time. Next, there is the step of striking a first area with the first electron. Next, there is the step of producing additional electrons at the first area due to the first electron. Then, there is the step of moving electrons from the first area to a second area. Next, there is the step of transmitting electrons to the second area and creating more electrons due to electrons from the first area striking the second area. Then, there is the step of striking a third area with the second electron. Next, there is the step of producing additional electrons at the third area due to the second electron. Next, there is the step of moving electrons from the third area to a fourth area. Then, there is the step of transmitting electrons to the fourth area and creating more electrons due to electrons from the third area striking the fourth area.

Micro-pulses or bunches are produced by resonantly amplifying a current of secondary electrons in an input rf cavity operating in a $TM_{110}$ rotating mode. Bunching occurs rapidly and is followed by saturation of the current density in ten to fifteen rf periods. The "bunching" process is not the conventional method of compressing or chopping a long beam into short beams, but results by selecting particles that are in phase with the rf electric field, i.e., resonant. One wall of the cavity is highly transparent (e.g. a grid) to electrons but opaque to the input rf field. The transparent wall allows for the transmission of the energetic electron bunches and serves as the cathode of a high-voltage injector. The reason for the name "Micro Pulse Gun" is the fact that the pulse is only a few percent of the rf period in contrast to the usual rf guns where the pulse width is equal to half the rf period.

Figure 1:
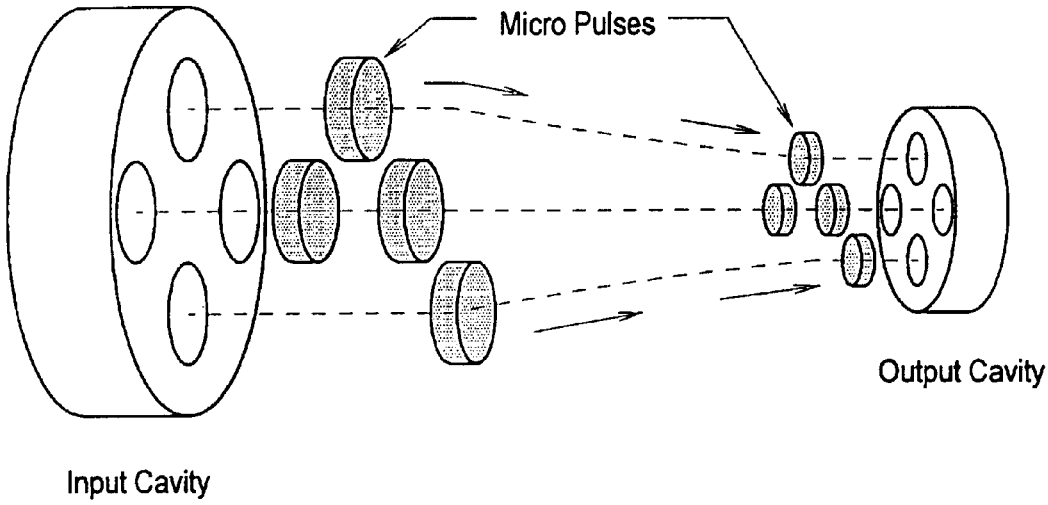
FIG. 1 Perspective view of Gatling MPG driving an output cavity. The post acceleration structure, magnetic compression system and collector are not shown.

FIG. 1 shows a perspective view of the Gatling micro-pulse gun emitting four (as an example) equally-spaced azimuthal electron-bunches. Emission is implemented from four emitting "button cathodes" rather than the entire cavity wall by choice of materials. The post-acceleration electrodes and magnetic compression coils are not shown in FIG. 1. Inside the input cavity, radial expansion is controlled by electric and magnetic fields. The four bunches are shown separated in time by $\tau/N_b$ where $\tau$ is the rf period of the $TM_{110}$ rotating mode and $N_b$ is the number of bunches equal to 4 in this case.

Figure 2:
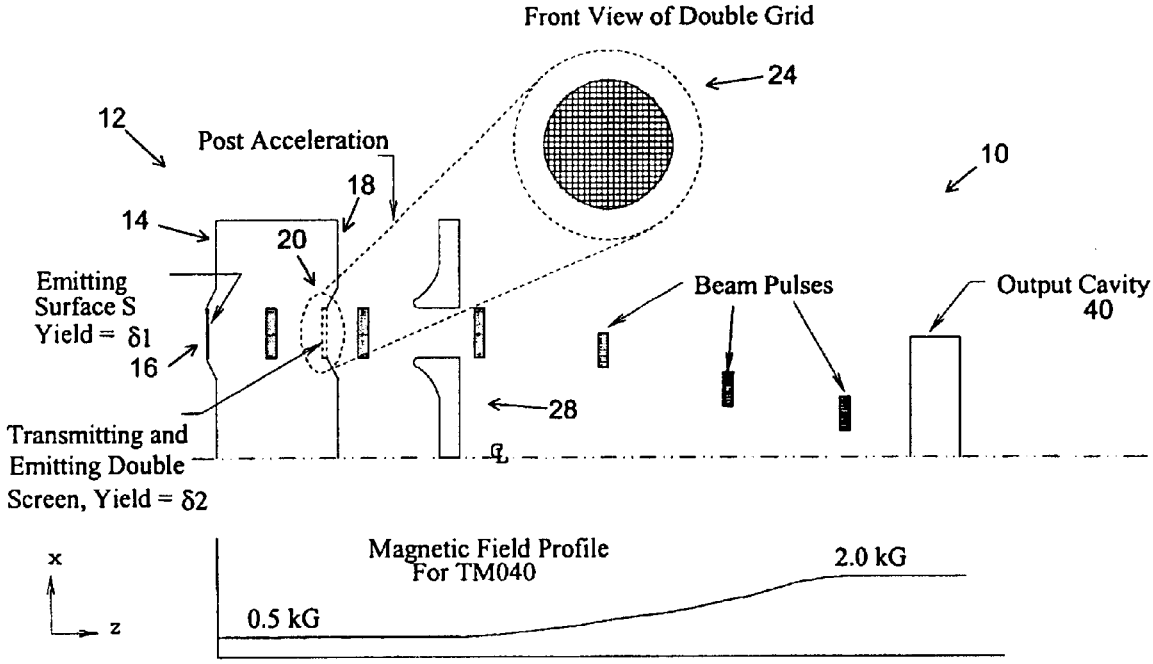
FIG. 2 Side view of GMPG input cavity showing double grid and emitting and transmitting surfaces. Electron bunches, concave shaping of the cavity, post acceleration section, magnetic compression for $TM_{040}$ mode, the output cavity and collector are also shown. Figure is not to scale.

The pulse width is small compared to $\tau/N_b$. Axial and radial expansion of the pulse is minimized outside the cavity by using rapid acceleration and a combination of electrostatic and magnetic focusing. The four bunches are compressed and transported into an output cavity. In order to reduce radial space charge expansion in the input cavity, the cavity should have a concave shape, as shown in FIG. 2 (this is only required when the axial magnetic field is desired to be small in the input cavity). The output cavity may operate in a $TM_{0m0}$ mode or a $TM_{m10}$ non-rotating or rotating mode. This Gatling micro-pulse electron gun provides a high peak power, multi-kiloampere, picosecond-long electron source which is suitable for many applications. Of particular interest are injectors for accelerators, 1.0–40 GHz rf generators for linear colliders and super-power nanosecond radar.

The right wall of the input cavity in FIG. 2 is constructed with a transmitting circular shaped double grid which allows for the transmission of high current density electron bunches. In addition to providing transmission for the electron bunch, the inside surface of the grid facing the interior of the cavity provides an emitting surface for electron multiplication. A path for the rf current is maintained by using radial and azimuthal wires. The double grid provides a means to isolate the post-accelerating field (outside the cavity) from the rf field. This prevents the accelerating field from pulling out electrons that are not resonant with the rf field. Also, the second grid (to the right) is electrically isolated from the first grid and can be dc biased (−500 to −1000 volts) to create a barrier for low energy electrons. The resonant particles are loaded into the wave at low phase angles. When they reach the output grid 180° later, they experience a reduced transverse kick from the grid wires. This reduces the emittance growth from the first grid in the Gatling MPG. The post-accelerating field increases the final emittance, but within acceptable levels.

To conceptualize how rapidly the current density can build up in the input cavity a simplified model is presented which excludes space charge, transit time, amplitude and phasing effects but shows the principle behind utilizing multipacting for the GMPG. In FIG. 2 is shown an rf input cavity operating in a $TM_{110}$ rotating mode. Assume that at the gridded wall of the cavity there is a single electron at rest and located radially at about half the cavity radius where the axial electric field peaks. Assume also, that this electron can transit the cavity in one-half the rf period and is in proper phase with the field. This electron is accelerated across the cavity and strikes the surface S. A number $\delta_1$ of secondary electrons are emitted off this electrode, where $\delta_1$ is the secondary electron yield of surface S. Assuming the electrons transit the cavity in one-half the rf period and they are in proper phase with the field, these electrons will be accelerated back to the grid. After reaching the grid, $\delta_1 T$ electrons will be transmitted, where T is the ratio of transmitted to incident electrons for the grid. The number of electrons which are absorbed by the grid is then $\delta_1(1-T)$. After one cycle the number of electrons that are produced by the grid is $\delta_2[\delta_1(1-T)]$, where $\delta_2$ is the grid secondary yield. To have electron gain, the number of secondaries must be greater then one, i.e. $\delta_2\delta_1(1-T)>1$. Current amplification occurs by repeating the above process. This is analogous to a laser cavity with the grid acting as a half-silvered mirror. The gain of electrons after N rf periods is $G=[\delta_2\delta_1(1-T)]^N$. If there is a "seed" current density $J_{seed}$ in the cavity initially, then after N rf periods the current density will be given by $J=GJ_{seed}=J_{seed}[\delta_2\delta_1(1-T)]^N$, until space-charge limits the current. For a very low seed current density a high current density can be achieved in a very short time. For example, if $\delta_2=\delta_1=8$, T=0.75,and $J_{seed}=1.4\times10^{-9}$ A/cm$^2$, in ten rf periods J=1500 A/cm$^2$!

The seed current density $J_{seed}$ can be created by several possible sources including thermionic emission, radioactivity, field emission or ultraviolet radiation. In the MPG a small thoriated tungsten loop of wire is used to create seed electrons. A similar arrangement is used in the GMPG.

Figure 3:
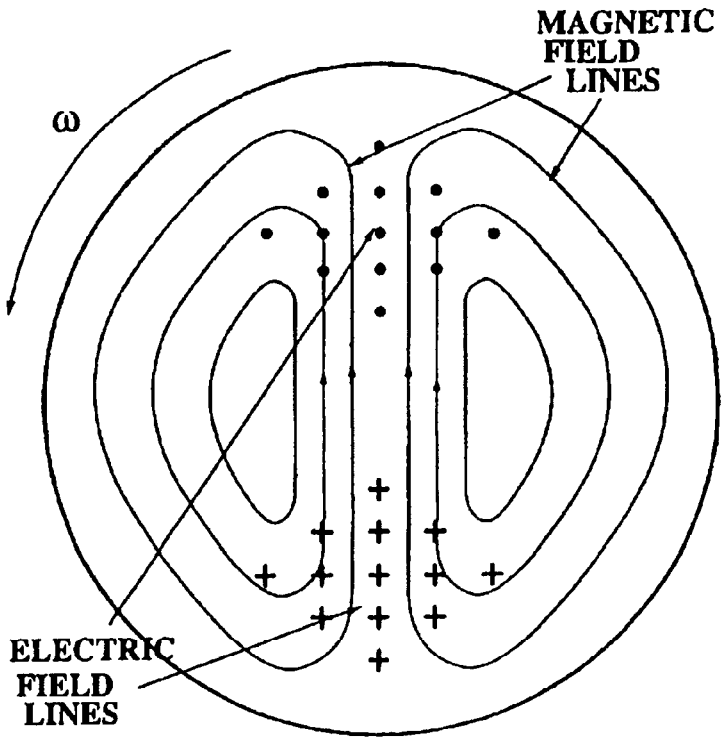
FIG. 3 $TM_{110}$ rotating mode electric and magnetic field pattern used in the GMPG.

The main idea that allows the Gatling micro-pulse gun (GMPG) to generate $N_b$ electron bunches or pulses per rf period follows from the rotating $TM_{110}$ mode. A simple way to visualize the $TM_{110}$ rotating mode is to realize that the electric field is constant in a coordinate frame rotating azimuthally about the axis at a radian frequency of $\omega$ which is also the radiation frequency. However, if one sits at a fixed radial and azimuthal position (off axis) in the cavity then there would only be an axial electric field that oscillates sinusoidally in time. FIG. 3 shows two dimensional view (looking down the axis into the cavity) of the electric and magnetic field lines for the $TM_{110}$ rotating mode. FIG. 3 shows electric field lines orthogonal to the plane of the paper and magnetic field lines in the plane of the paper.

If $r_{ci}$ is the input cavity radius, consider the radial position where the electric field is a maximum (which is about $r_{ci}/2$) and then select periodically in the azimuthal direction high secondary electron emission areas (spots), e.g., four spots ($N_b$=4). As the electric field (with the right phase, polarity and magnitude) passes by a spot a secondary electron emission bunch will be formed and phase locked to the electric field. This phase locking has been verified extensively. Thus, in this example, four equally spaced electron bunches will form in an rf period. In the general case of $N_b$ spots in the azimuthal direction, $N_b$ electron bunches would form in an rf period.

The secondary emission yield $\delta$ is defmed to be the average number of secondary electrons emitted for each incident primary electron and is a function of the primary electron energy e. $\delta$ for all materials increases at low electron energies, reaches a maximum $\delta_{max}$ at energy $\epsilon_{max}$, and monotonically decreases at high energies. Table I gives some commonly used materials with high and low values of $\delta$ [D. E. Gray (coord. Ed.), Amer. Inst. of Physics Handbook, 3rd Edition, McGraw-Hill; E. L. Garwin, F. K. King, R. E. Kirby and O. Aita, J. Appl. Phys. 61, 1145 (1987); A. R. Nyaiesh, et al., J. Vac. Sci. Tech. A, 4, 2356 (1986); S. Michizono, et al., J. Vac. Sci. Tech. A, 10, 1180 (1992)]

TABLE I

Secondary emission coefficient of some common materials.

| Material | $\delta_{max}$ | $\epsilon_{max}$ (keV) |
|---|---|---|
| Diamond + Cs | 55 | 5 |
| MgO (crystal) | 20–25 | 1.5 |
| GaP + Cs (crystal) | 147 | 5 |
| Sapphire | 10–14 | 1.3 |
| TiN coating | 1–1.6* | 0.3 |
| Pure Carbon | 0.8 | 0.3 |
| Titanium | 0.9 | 0.28 |

(*Yield depends on: coating thickness, substrate material, electron dose, exposure to air and temperature.)

Several photomultipliers (RCA C31024, RCA C31050 and RCA 8850) are built with GaP dynodes. GaP is not sensitive to oxygen but is sensitive to water. Thus GaP has been rejected for use as a high secondary emitter. MgO is a good candidate for lower particle energy (<60 keV) and would have to be applied in a thin layer in order to avoid charge buildup. Another very robust emitter material that is currently under intensive study is diamond film. Diamond films have been very successfully used. Diamond is the material of choice for the GMPG since it is durable and can be exposed to air (robust) and has a reasonable yield up to about 300 keV.

The entire GMPG cavity (except for the specified secondary emission sites) needs to be built with a low secondary emission coefficient. Referring to Table I, carbon appears to be the most desirable material. However, given its porosity, vacuum problems may occur. In addition, vacuum seals will be difficult. Furthermore, with its high electrical resistivity, the unloaded cavity Q will be too low. A pure titanium cavity seems to be a good solution since it has a low secondary yield and excellent vacuum properties; however, its high electrical resistivity gives a low unloaded cavity Q.

Cavity surface coatings can give a factor of two improvement in breakdown field along with several orders of magnitude reduction in dark emission current on an OFHC copper cavity. $CaF_2$ and TiN are excellent candidates for cavity coatings. These would be the preferred coatings for high average power cavities. For a low average power cavity, 304 stainless steel works well.

Figure 4:
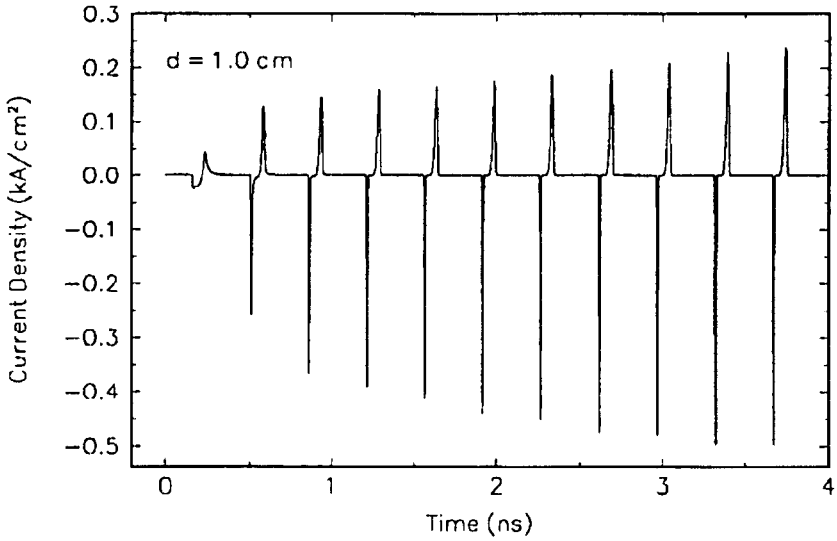
FIG. 4 Plots of current density vs. time for simulation with rf frequency 2.85 GHz, $\alpha_o=eV_o/(m\omega^2d^2)=0.373$, d=1.0 cm and a peak rf voltage of $V_o$=68 kV.

The GMPG has been fully characterized. Input parameters for the GMPG input cavity are: peak rf voltage ($V_o$) frequency (f), cavity gap spacing (d), and magnetic focusing field ($B_o$). Output parameters are: current density, particle energy, transverse emittance and pulse width. FIG. 4 shows the current density as a function of time for: f=2.85 GHz, d=1.0 cm, and $V_o$=68 kV. Current density is evaluated near the exit grid (right side of input cavity, FIG. 2). A positive current density is the current that travels from right to left. A negative current density describes the exiting beam. Current asymmetry occurs because the positive/negative beam pulses have substantially different charge densities and velocities at the exit grid. In FIG. 4 at a gap length of 1.0 cm, the saturated current density $J_s$ after about 10 rf periods is 500 A/cm$^2$ at $V_o$=68 kV with a $\alpha_0$=0.373. Where the normalized drive voltage is a $\alpha_o=eV_0/m\omega^2d^2$ and e, m are the electron charge and mass, respectively and $\omega=2\pi f$.

Figure 5:
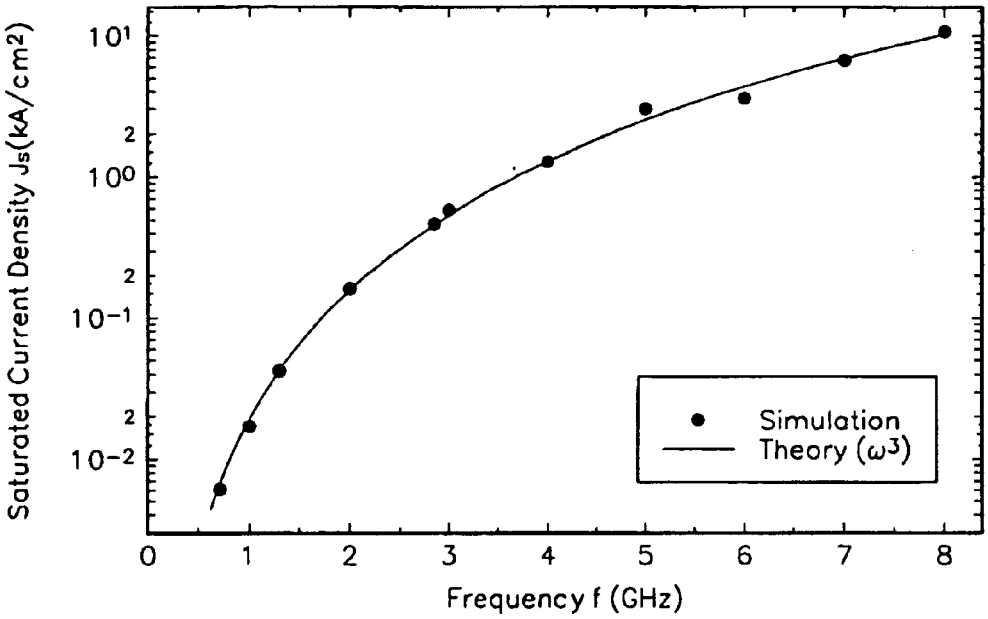
FIG. 5 Comparison of saturated current density in kA/cm$^2$ versus frequency for simulation and analytic theory for a gap length of d=1.0 cm and normalized drive voltage $\alpha_o=eV_o/(m\omega^2d^2)=0.373$.

The saturated current density is defined to be the peak current density after 10 to 15 rf cycles, i.e. where the amplitude becomes constant. Results at various frequencies for the current density inside (with T=0) the GMPG are shown next. FIG. 5 shows the results for the saturated current density $J_s$ vs. rf frequency for a cavity with a 1.0 cm gap length and for $\alpha_0$=0.373. The curve obeys a power law $J_s \propto \omega^3$.For f=2.85 GHz the saturated current density is about 500 A/cm$^2$. Note that $V_o \propto \omega^2$ must be maintained for resonance at fixed $\alpha_o$.

Figure 6:
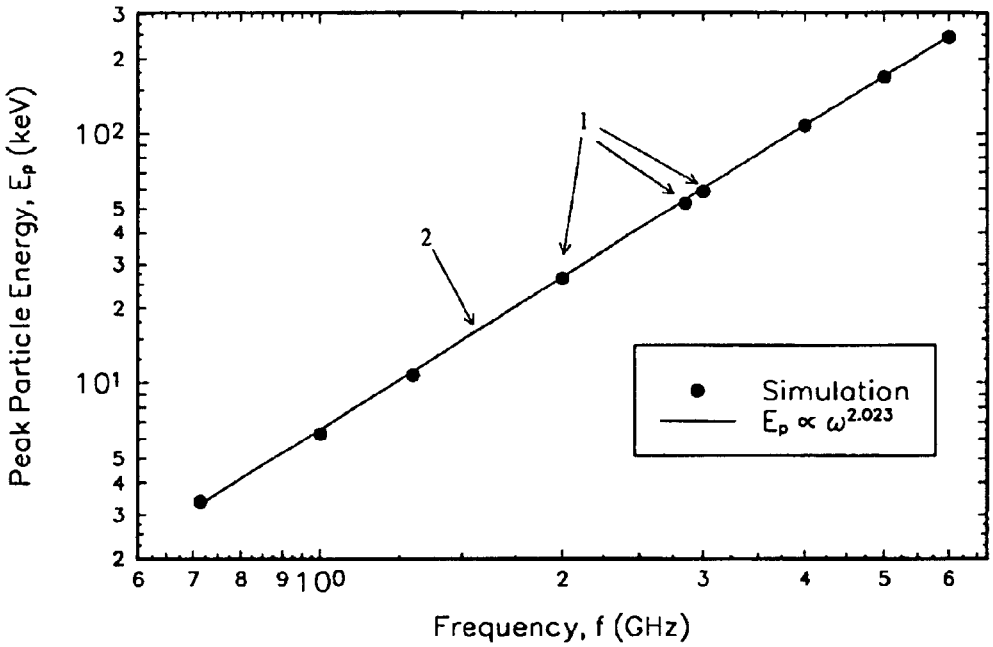
FIG. 6 Plot of Peak Particle Energy vs Frequency.

The corresponding particle energy at the peak of the distribution is plotted as a function of frequency in FIG. 6. The particle energy scales like the square of the frequency. And since the resonant voltage also scales like the frequency squared then the particle energy scales linearly with the resonant voltage.

Figure 7:
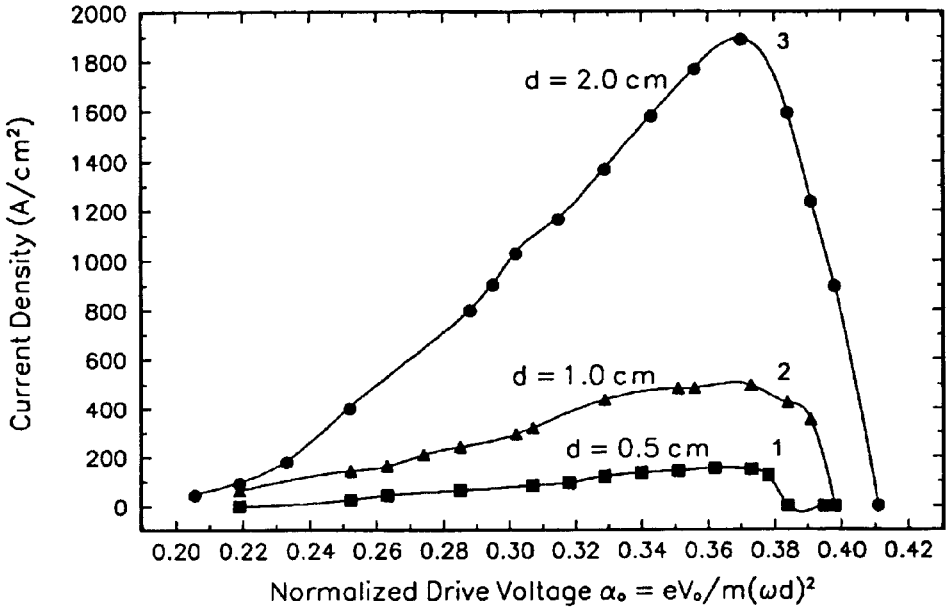
FIG. 7 Plot of Saturated Current Density vs Normalized Drive Voltage; f=2.85 GHz. The gap spacing d=1.0 cm and the normalized drive voltage$\alpha_0=eV_0/(m\omega^2d^2)=0.373$.

The saturated current density rises approximately linearly with the normalized drive voltage, $\alpha_o=eV_0/m\omega^2d^2$, within the resonance window FIG. 7. Each curve is a spline fit to the data. The saturated current density is the peak current density, after 10 to 15 cycles, from the current density vs time traces like that shown previously. The current density plots also show the "tuning range" for the GMPG. A very tolerant tuning range is a key result. Even if the electric field changed by 30% from, say, beam loading, resonance would still occur but at a lower current density.

Figure 8:
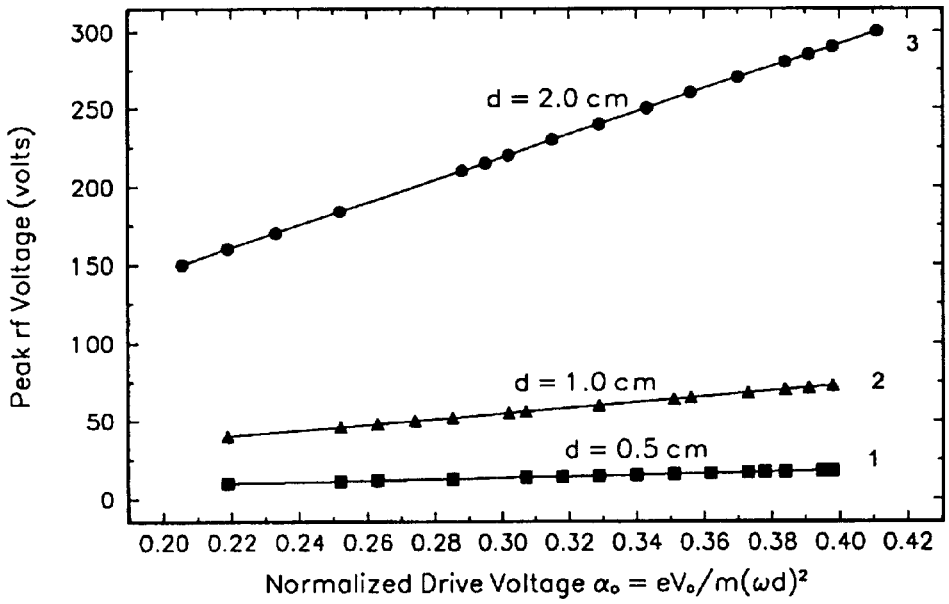
FIG. 8 Plot of Peak rf Voltage vs Normalized Drive Voltage; f=2.85 GHz.

FIG. 8 gives the peak voltage ($V_0$) as a function of the normalized drive voltage ($\alpha_o$) for different gap spacings at a frequency of 2.85 GHz. This figure gives the drive voltages used to maintain resonance for the results in FIG. 7. These voltages or the corresponding electric fields have been shown to be easily within the limits of breakdown.

Figure 9:
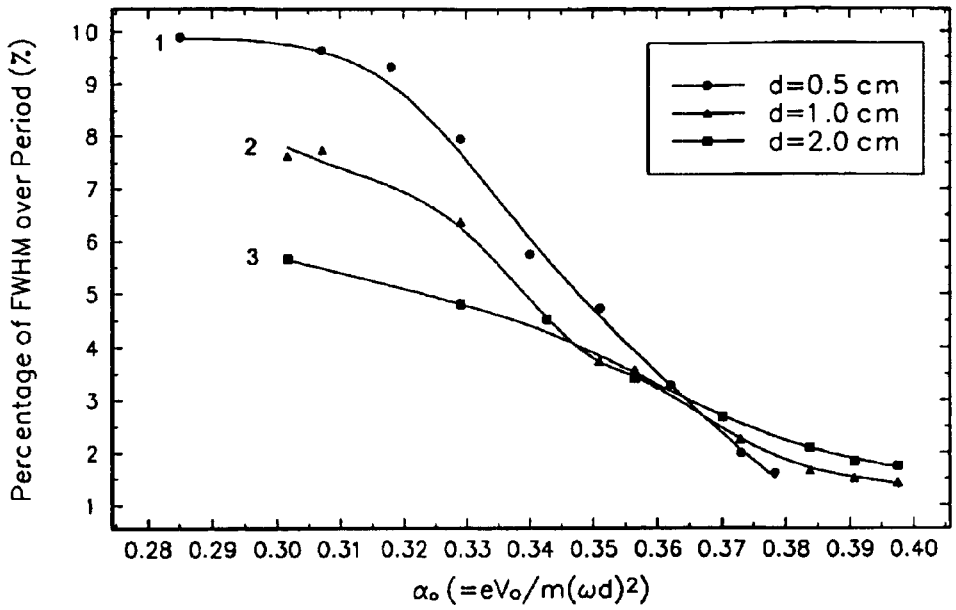
FIG. 9 Plot of Micro-Pulse Width vs Normalized Drive Voltage at a frequency of f=2.85 GHz.

FIG. 9 shows that the micro-pulse width can be adjusted using the drive voltage ($V_0$). Depending on gap spacing (d) and $\alpha_0$the pulse width can be adjusted from 1.5% to 10% of the rf period. For the case: $\alpha_0 \approx 0.373$, d=1 cm and $V_0$=68 kV the bunch length is 7 ps at a frequency of 2.85 GHz.

Figure 10:
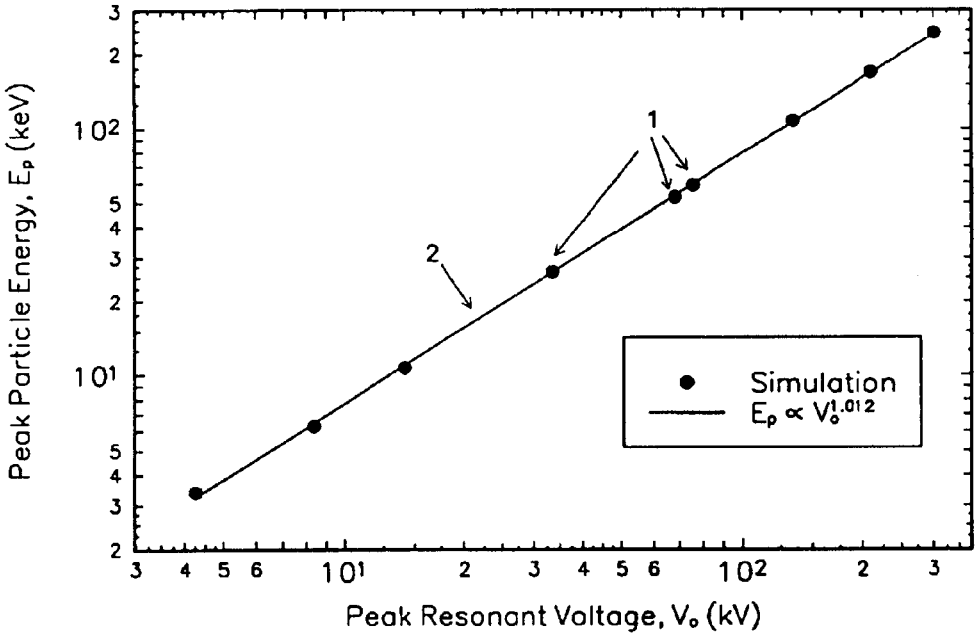
FIG. 10 Plot of Peak Particle Energy vs Peak Resonant Voltage. The gap spacing d=1.0 cm and frequency f=2.85 GHz.

FIG. 10 shows that the particle energy at the peak of the distribution scales linearly with the peak rf voltage. In fact the particle energy reaches the theoretical maximum value for a particle that starts at zero phase angle and zero electric field and ends up at zero electric field with a phase angle of $\pi$.

Figure 11:
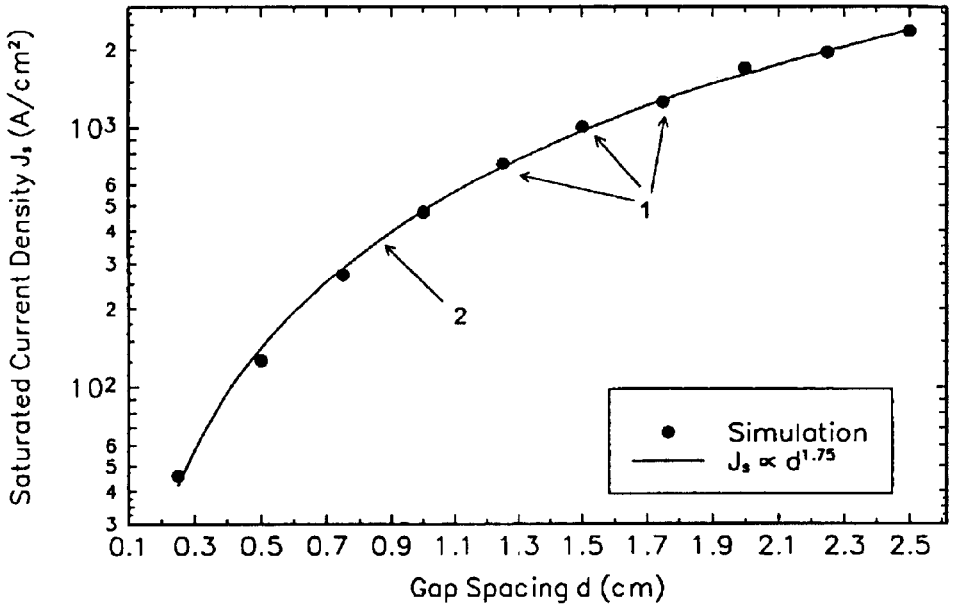
FIG. 11 Plot of Saturated Current Density vs Gap Spacing; f=2.85 GHz and $\alpha_0=eV_o/(m\omega^2d^2)=0.373$.

FIG. 11 shows the data with a fitted curve of the saturated current density dependence on the gap spacing while maintaining resonance. The current density scales like the gap spacing raised to the 1.75 power.

Figure 12:
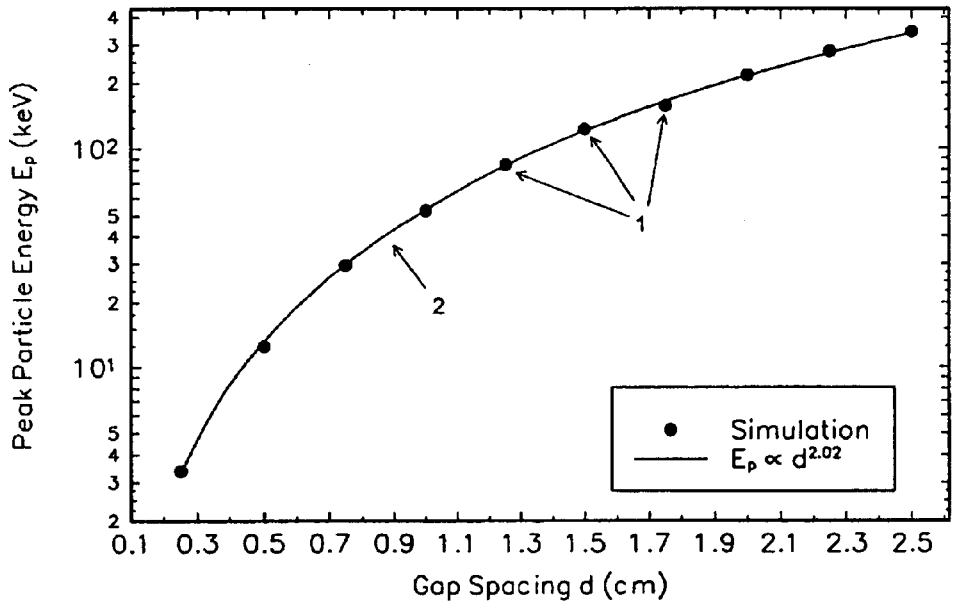
FIG. 12 Plot of Resonant Peak Particle Energy vs Gap Spacing; f=2.85 GHz and $\alpha_0=eV_o/(m\omega^2d^2)=0.373$.

FIG. 12 shows the corresponding particle energy at the peak of the distribution as a function of the gap spacing. Essentially the particles reach the maximum possible energy in a sine wave starting near zero phase angle and ending near a phase angle of $\pi$.

Figure 13:
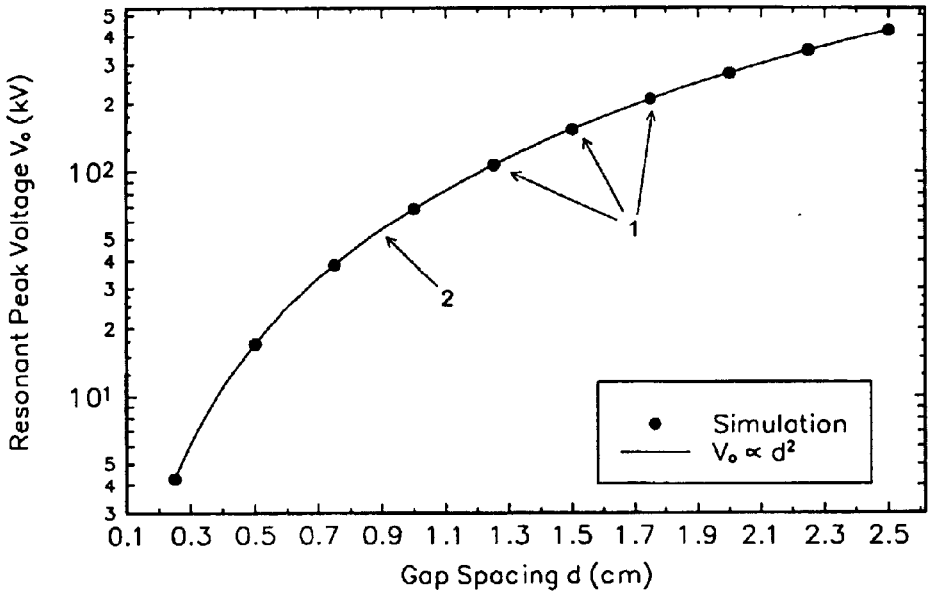
FIG. 13 Plot of Resonant Peak rf Voltage vs Gap Spacing; f=2.85 GHz and $\alpha_0=eV_o/(m\omega^2d^2)=0.373$.

FIG. 13 shows the peak resonant voltage for the cavity as a function of gap spacing. The voltage scales like the gap spacing squared for fixed $\alpha_o$ as described by the relation for $\alpha_o=eV_o/(m\omega^2d^2)$.

Figure 14:
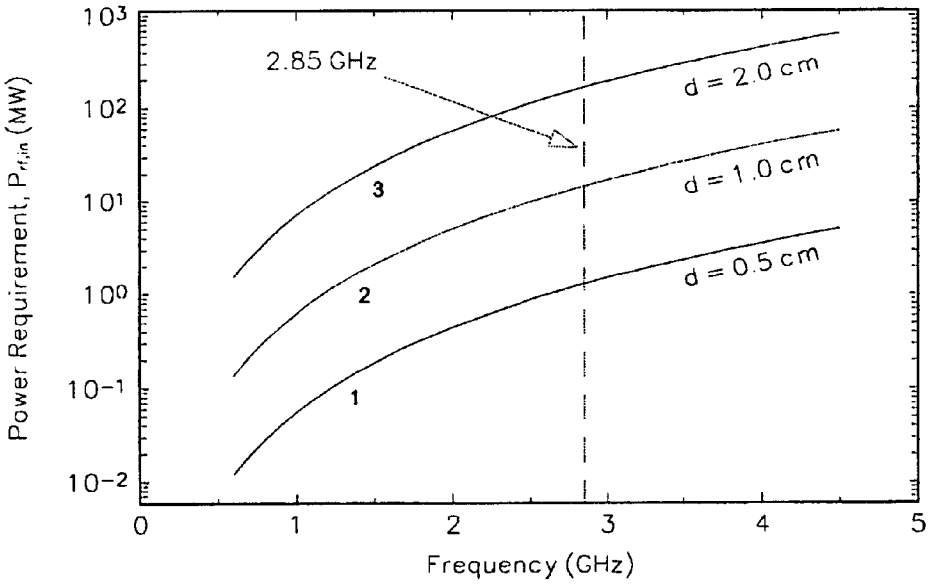
FIG. 14 Plot of rf power input requirement as a function of the drive frequency for $N_b$=4, $\Delta E/E$=0.1 and $\alpha_0$=0.373.

FIG. 14 shows a plot of the input cavity power required as a function of frequency for different gap spacings. The number of bunches is $N_b$=4, f=2.85 GHz, d=1 cm,$_o$V=68 kV, $\alpha_o$=0.373 and the electron bunch energy spread is $\Delta E/E$=0.1, then the required input power is $P_{rf,in}$=14.4 MW. To stay in resonance $V_o \sim (fd)^2$ for fixed $\alpha_o$. Note that the electron bunch energy spread $\Delta E/E$ comes from the diameter of the emission area. The if voltage decreases as the electron emission diameter increases, thus the electrons in a bunch receive an energy spread. The required rf power is directly proportional to the electron bunch energy spread.

Figure 15:
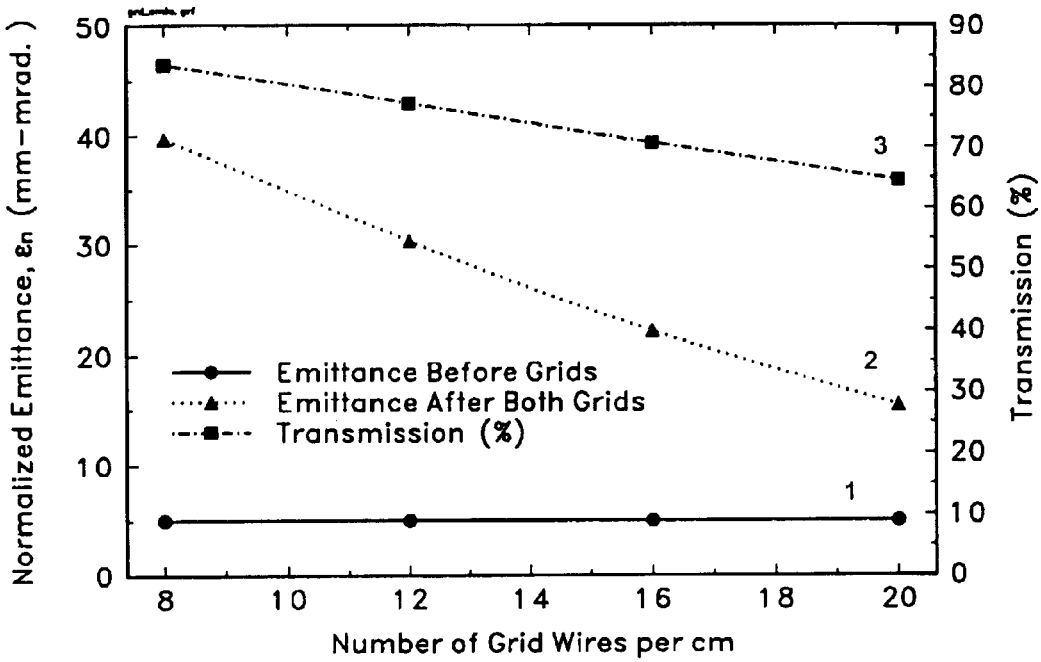
FIG. 15 Plot of Emittance growth due to double-grid extraction with an injection beam energy of 50 kV. The wire thickness is 0.1 mm.

FIG. 15 illustrates the beam emittance and transmission (T) for a wire thickness of 0.1 mm. The plots are emittance and transmission versus the number of wires per cm. Note from the plots in FIG. 15 that for a span of 14 wires/cm, a transmission efficiency of ~75% can be obtained with a final beam emittance of 25 mm-mrad.

Post-acceleration of the beam as it emerges from the input cavity of the GMPG is required to allow successful transport of the high-current micro bunches and thus to increase the beam energy for conversion to rf power inside the output cavity. Post-acceleration is accomplished using pulsed high voltage.

Most linac injectors accelerate the beam to a few MeV, typically starting from an e-gun voltage of 100 kV. This brings the beam to a relativistic velocity, and reduces the perveance, hence space charge effects, to a manageable level. In the GMPG application as a driver for the Next Linear Collider (NLC), the bunch particle energy will be accelerated from 50 keV to 650 keV. At these parameters the average beam power is 72 MW. This power level is sufficient for the production of 50 MW of 11.4 GHz microwave radiation in the output cavity. An appropriately shaped (to minimize field enhancement) post-acceleration geometry is employed in the acceleration process. This geometry is achieved by providing a 45° radial focusing electrode after the second grid. Also, the transverse field at the second grid is reduced significantly which minimizes the emittance growth. A 10.9 mm-radius bunch with a particle energy of 50 keV is injected into the accelerating section. The voltage applied between the accelerating electrode and cavity wall is 600 kV. The accelerating gap spacing, $L_a$, is varied from 2–5 cm with insignificant changes in the results. An accelerating gap spacing of 5 cm is selected to prevent breakdown problems.

Figure 16:
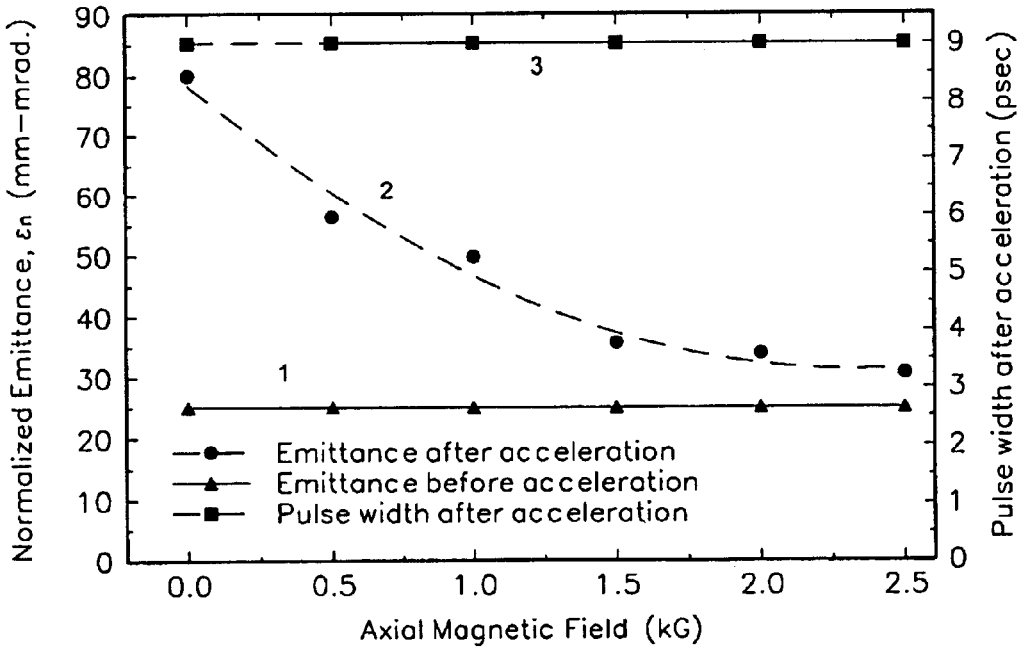
FIG. 16 Plot of Bunch emittance after beam post-acceleration vs axial magnetic field, $B_o$. Also shown is pulse width after post-acceleration. Initial pulse width is $\tau_p$=7 ps. Parameters employed are 12 MV/m, $L_a$=5 cm, $r_b$=10.9 mm, J=375 A/cm$^2$ and the transmission factor is T=0.75.

FIG. 16 is a plot of the bunch normalized emittance, measured after acceleration, as a function of the applied axial magnetic field, $B_o$. It can be clearly seen that as the axial magnetic field is increased emittance growth during acceleration is reduced. It should also be noted that the pulse width at injection is 7 ps. For all the cases shown in FIG. 16, the pulse width expansion during acceleration is about 28.6% yielding a pulse width of about 9 ps at the end of the accelerating process, regardless of the amount of axial magnetic field.

After post-acceleration, the micro-bunches have to be prepared for the interaction in the output cavity. Magnetically compressing the bunches in radius after acceleration allows injection into the output cavity. The compression is done so that the radial displacement of the bunches, after compression, is equal to the radius at which the cavity electric field peaks in the output cavity. For the $TM_{040}$ mode operating at 11.4 GHz, the second lobe of the electric field peaks at a radius of 2 cm.

Figure 17:
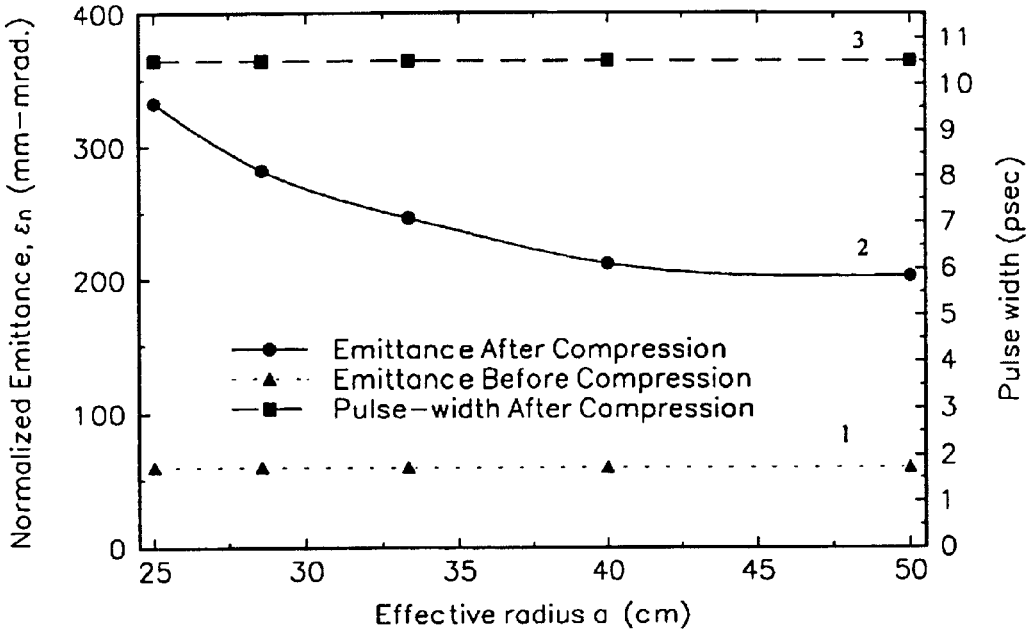
FIG. 17 Plot of Results of the normalized bunch emittance and pulse width after compression for different solenoid radii, a. The initial pulse width is $\tau_p$=9 ps.
Figure 18:
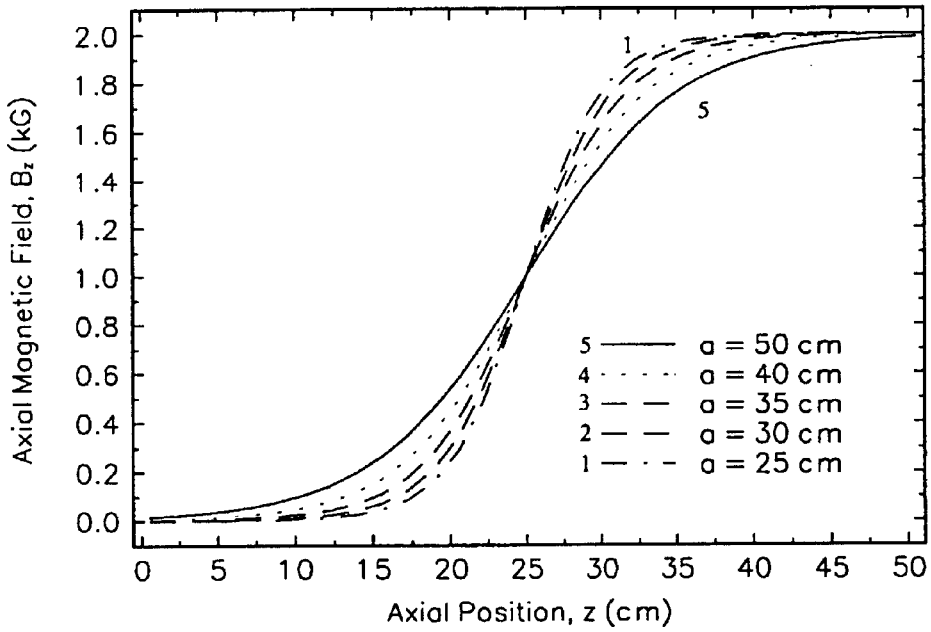
FIG. 18 Plots of the on-axis axial magnetic field are shown as a function of the axial coordinate for different values of solenoid radii.

Due to the high-current of the bunches and in order to avoid axial expansion, it was required to have rapid compression of the beam to preserve the beam quality necessary for an efficient interaction in the output cavity. The focusing magnetic fields employed were (approximately) the near-axis magnetic fields of a solenoid. The micro-bunches, as they come from the post-acceleration region, are injected at full energy (650 kV) into a drift region solely under the influence of the compressing fields. The current density is fixed to 375 A/cm$^2$ with a beam cross-section of 3.73 cm$^2$ and initial pulse width of 9 ps The injection distance for each bunch from the system axis is fixed to 3.2 cm. FIG. 17 summarizes the beam transport results obtained. FIG. 17 shows the resulting bunch emittance and pulse width after compression as a function of solenoid effective radius, a, for the parameters above. The profile of the axial magnetic field, measured on axis, is shown for different solenoid radii in FIG. 18.

The following is the production of coherent microwave radiation in a cylindrical cavity operating in the $TM_{040}$ mode. The driving source is a group of high-current short electron bunches arriving in the cavity one every rf period of the output radiation frequency. The bunches are 1.09 cm in diameter and have a duration of 10.5 ps. The intention was to force the bunches to couple with the axial electric field of the second radial lobe of this mode. The electric field of second lobe peaks at a radial distance $r_p$. For 11.4 GHz radiation, and for a $TM_{040}$ mode $r_p$=1.6 cm. Thus, the $N_b$ bunches are injected into the cavity at this radial position. For the $4^{th}$ harmonic, four beam holes equally-spaced azimuthally were opened on the cavity walls (front and back faces). FIG. 19 illustrates the overall schematic of the GMPG system. After formation of the bunches in the input cavity, they undergo acceleration and adiabatic magnetic compression before entering the output cavity.

The cavity is of cylindrical geometry with a radius of 4.94 cm and length $L_c$~1 cm. Four openings are inserted along the front and back faces of the cavity to allow the passage of the micro-bunches. The diameter of each beam "tube" is 1.5 cm and its distance from the axis is 1.6 cm. Bunches are injected into the cavity with an energy of 650 kV, pulse width ($\tau_p$) of 10.5 ps, and a normalized emittance of 225 mm-mrad. The current in each bunch is typically 1400 A and the beam radius ($r_b$) is 5.45 mm. Each bunch enters the output cavity at a radial position of 1.6 cm from the cavity axis every 88 ps. The bunches arrive into the beam tubes clockwise or counterclockwise, the direction depending on the direction of rotation of the rotating mode in the modulating input cavity. Thus, in one input rf period, 4 bunches arrive into the output cavity, each arriving into a different beam tube.

Figure 20:
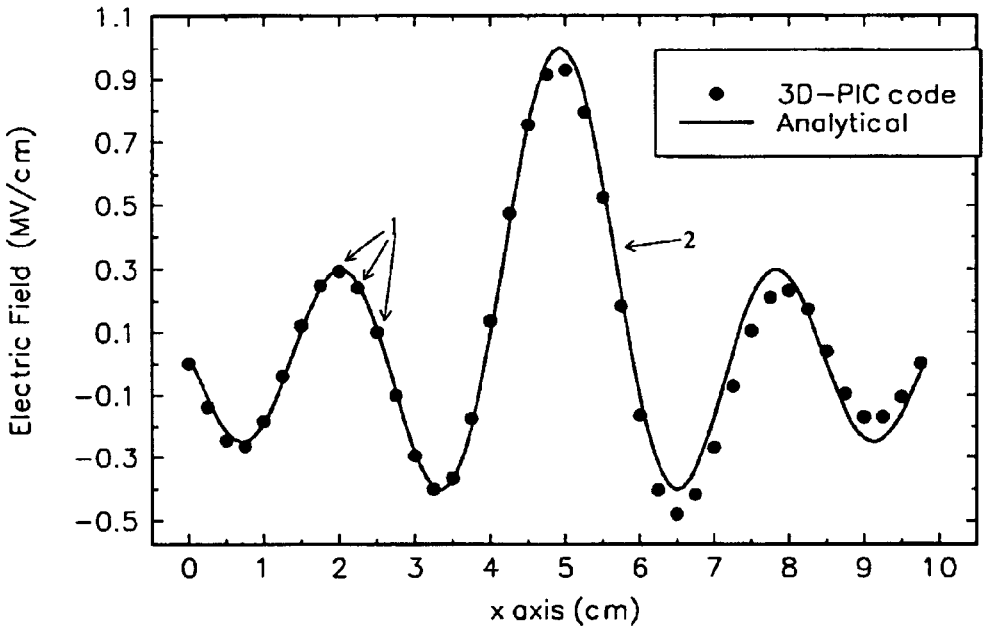
FIG. 20 Spatial distribution of the rf electric field excited inside the output cavity by the micro-pulses is shown as a function of the transverse x coordinate. The profile for the $TM_{040}$ mode is also shown (solid line). Final electron bunch voltage is $V_a$=650 kV and pulse width is $\tau_p$=10.5 ps.
Figure 21:
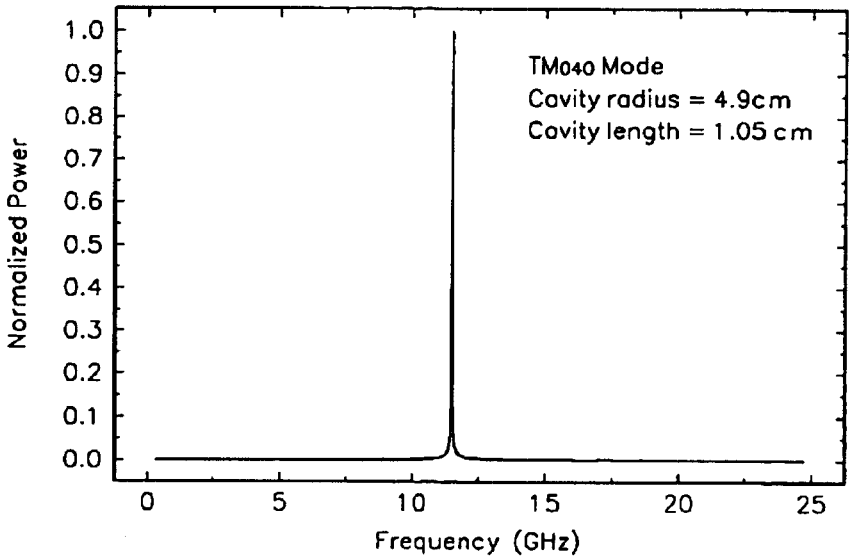
FIG. 21 Frequency spectrum of the field shown in FIG. 20. Single mode excitation is achieved at 11.4 GHz. Final electron bunch voltage is $V_a$=650 kV and pulse width is $\tau_p$=10.5 ps.

From the signals excited inside the cavity, a fast Fourier transform is used to determine the frequency spectrum of the signal. Also, the spatial profile of the fields inside the cavity are determined. FIG. 20 shows the axial electric field obtained at center of the cavity versus the transverse coordinate x. The profile of the electric field for the $TM_{040}$ is shown. This figure shows mode locking. Note, in FIG. 20, that for values of x (x is the transverse cavity coordinate; x=5 cm is the hole center) between 6 and 8 cm the electric field wave is slightly deformed. This perturbation comes from the presence of the driving electron bunch in that lobe at that instant. FIG. 21 shows the frequency spectrum of the wave excited by the bunches inside the cavity. It can be seen that single mode excitation is achieved at 11.4 GHz with no mode competition.

The next step is to find how the bunch emittance affected the efficiency of the output interaction. As seen in previous paragraphs, the bunches after acceleration and beam compression undergo emittance growth and pulse width expansion. It was shown, for the parameters of interest, that after magnetic beam compression a micro-pulse with a pulse width of 10.5 ps with a normalized emittance of ~225 mm-mrad could be produced. Thus, it was of interest to determine how the efficiency degraded with beam quality.

Figure 22:
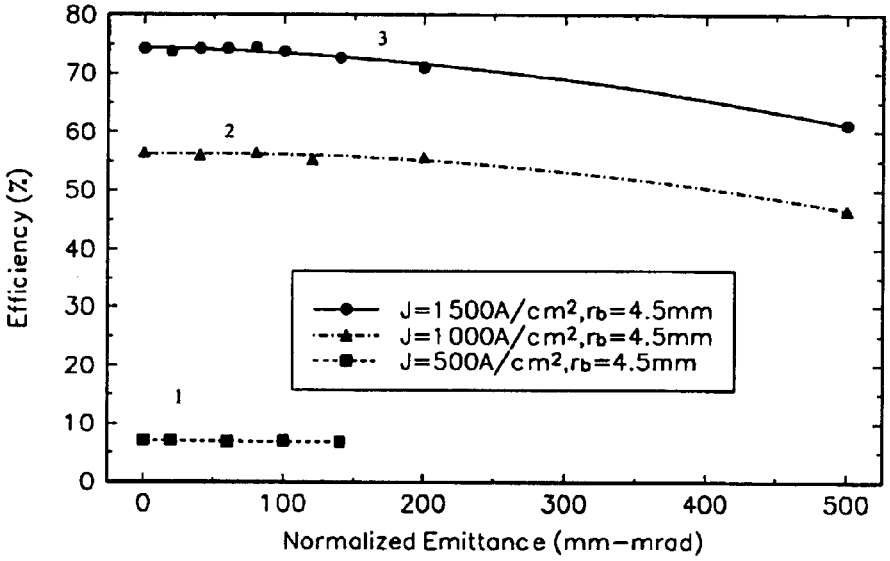
FIG. 22 Plots showing the output cavity efficiency as a function of the bunch emittance. In each case, the beam current and beam emittance are adjusted before injection into the output cavity. The beam radius is $r_b$=5.45 mm. $TM_{040}$ mode, f=11.4 GHz, $L_c$=1.05 cm, $V_a$=650 kV, $B_o$=2 kG and $\tau_p$=10.5 ps.

The rf efficiency is defined simply as the ratio of rf power excited by the beam divided by the average beam power. The summary of rf efficiency versus emittance is shown in FIG. 22. In the figure, plots of efficiency as a function of bunch emittance are shown for different values of beam current density. The following parameters are used: electron energy is 650 kV with a beam radius of 5.45 mm, axial magnetic field of 2 kG, frequency of 11.4 GHz and a cavity length of 1.05 cm. It shows that for J=1500 A/cm$^2$ and an emittance of 225 mm-mrad, a conversion efficiency of about 72% is obtained. At this current density, a saturation condition is approached. Bunch lengths of 10.5 to 18 ps do not affect the efficiency.

The device performance was set at an rf output power of 50 MW at 11.4 GHz. The resulting system efficiency is 59% without beam energy recovery and 75% with beam energy recovery. The system efficiency includes the input cavity efficiency and input driver efficiency (a 15 MW klystron at 2.85 GHz) and the beam collector conversion efficiency. For energy recovery a depressed collector is used.

Table II shows the parameters for this device with a factor of four in frequency multiplication. Note that a factor of four in magnetic compression is required for spatially matching the beam bunches from the input cavity operating at 2.85 GHz with the $TM_{110}$ rotating mode to the output cavity operating at 11.4 GHz with the $TM_{040}$ mode. Beam pulses are generated at about half the respective cavity radius which corresponds to the peak of the axial electric field.

TABLE II

Parameters for an 11.4 GHz Device

| Parameter | Quantity |
|---|---|
| No. of bunches leaving input cavity per rf period | 4.000 |
| Bunch current leaving input cavity | 1400 A |
| Bunch charge leaving input cavity | 9.8 nC |
| Bunch duration from input cavity | 7 ps |
| Particle energy leaving input cavity | 50 keV |
| Bunch radius leaving input cavity | 10.9 mm |
| Input cavity frequency with $TM_{110}$ rotating mode | 2.85 GHz |
| Input cavity radius and length | 6.416 cm, 1.0 cm |
| Input cavity power | 15 MW |
| Output cavity frequency with $TM_{040}$ mode (Beam injection into the second radial lobe) | 11.4 GHz |
| Bunch duration into output cavity | 10.5 ps |
| Bunch radius entering output cavity | 5.45 mm |
| Bunch normalized emittance entering output cavity | 225 mm-mrad |

TABLE II-continued

Parameters for an 11.4 GHz Device

| Parameter | Quantity |
|---|---|
| Output cavity radius | 4.9 cm |
| Output cavity beam pulse conversion efficiency | 72% |
| Output cavity power | 52 MW |
| Final beam energy | 650 keV |
| System efficiency without energy recovery | 59.2% ** |
| System efficiency with energy recovery | 74.7% ** |
| System gain | 50 dB * |
| Magnetic field starting at the input cavity and peaked at the output cavity | 0.5 kG to 2.0 kG |

Transmission factor, T=0.75, energy spread $\Delta E/E=10\%$, * the system gain is dominated by the gain of the Klystron which drives the input cavity, ** the system efficiency includes the efficiency of the input cavity Klystron efficiency=70% and $\eta_{col}=90\%$.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An electron gun comprising:

an rf cavity having a first side with multiple emitting surfaces and a second side with multiple transmitting and emitting sections, the corresponding multiple sections include transmitting and emitting double grids through which electrons escape and additional electrons are generated; and a mechanism for producing a rotating and oscillating force in a $TM_{110}$ rotating mode which encompasses the multiple emitting surfaces and the multiple sections so electrons are directed between the respective multiple emitting surfaces and the corresponding multiple sections to contact the respective multiple emitting surfaces and generate additional electrons and to contact the corresponding multiple sections to generate additional electrons or escape the cavity through the corresponding multiple sections.

2. A gun as described in claim 1 wherein said corresponding sections isolating the cavity from forces outside and adjacent the cavity.

3. A gun as described in claim 2 wherein the producing mechanism includes a mechanism for producing a rotating and oscillating electric field that provides the rotating and oscillating force and the field has a radial component that confines the electrons to respective regions between the respective emitting double grids and the emitting surfaces.

4. A gun as described in claim 3 including a mechanism for producing a magnetic field to confine the electrons to corresponding multiple transmitting and emitting regions between the respective multiple transmitting and emitting double grids and the respective multiple emitting surfaces.

5. A gun as described in claim 3 wherein the mechanism includes a mechanism for producing multiple bunches of electrons in corresponding multiple regions between the respective multiple transmitting and emitting double grids and the multiple emitting surfaces.

6. A gun as described in claim 3 wherein the multiple transmitting and emitting double grids are of a circular shape.

7. A method for producing electrons comprising the steps of:

moving a first electron in a first direction in an rf cavity subject to a $TM_{110}$ rotating mode;

moving at least a second electron in the first direction at a second time in the rf cavity subject to the $TM_{110}$ rotating mode;

striking a first transmitting and emitting double grid with the first electron;

producing additional electrons at the first transmitting and emitting double grid due to the first electron;

moving the additional electrons from the first transmitting and emitting double grid to a second transmitting and emitting double grid in the rf cavity subject to the $TM_{110}$ rotating mode;

transmitting the additional electrons through the second transmitting and emitting double grid and creating more electrons due to electrons from the first transmitting and emitting double grid striking the second area;

striking a third transmitting and emitting double grid with the second electron;

producing additional electrons at the third transmitting and emitting double grid due to the second electrons;

moving electrons from the third transmitting and emitting double grid to a fourth transmitting and emitting double grid in the if cavity subject to the $TM_{110}$ rotating mode; and transmitting electrons through the fourth transmitting and emitting double grid and creating more electrons due to electrons from the third transmitting and emitting double grid striking the fourth transmitting and emitting double grid.

* * * * *